United States Patent [19]

Gentile

[11] 4,139,127

[45] Feb. 13, 1979

[54] PLUNGER-TYPE DISPENSER WITH RATCHET ACTUATOR

[75] Inventor: Charles J. Gentile, North Caldwell, N.J.

[73] Assignee: Orange Products, Inc., Chatham, N.J.

[21] Appl. No.: 751,126

[22] Filed: Dec. 16, 1976

[51] Int. Cl.[2] ..... B65D 5/42

[52] U.S. Cl. ..... 222/390; 222/391

[58] Field of Search ..... 128/326; 401/175; 222/390, 391

[56] References Cited

U.S. PATENT DOCUMENTS

| | | | |
|---|---|---|---|
| 835,606 | 11/1906 | Frimand | 222/390 |
| 1,599,660 | 9/1926 | Little et al. | 222/390 X |
| 1,644,173 | 10/1927 | Carr | 222/390 |
| 2,908,925 | 10/1959 | Reitknecht | 401/175 |
| 2,917,765 | 12/1959 | Jakubowski | 401/175 |
| 3,212,120 | 10/1965 | Gentile | 401/175 |
| 3,756,730 | 9/1973 | Spatz | 222/390 X |

*Primary Examiner*—David A. Scherbel

*Attorney, Agent, or Firm*—Carella, Bain, Gilfillan & Rhodes

[57] ABSTRACT

A dispenser for dispensing dispensable material such as creams, emulsions or the like, including structure for controlling the direction of rotation of the applicator which causes dispensing of the dispensable material whereby a user of the dispenser is able only to rotate the applicator in the proper direction which causes dispensing and is not able to rotate the applicator in the improper direction which does not cause dispensing. Also, an applicator provided with structure for preventing post-dispening of dispensable material wherein unwanted further dispensing of dispensable material is prevented upon cessation of rotation of the applicator to cause wanted dispensing of dispensable material.

3 Claims, 6 Drawing Figures

PLUNGER-TYPE DISPENSER WITH RATCHET ACTUATOR

BACKGROUND OF THE INVENTION

This invention relates generally to dispensers and in particular relates to an improvement in dispensers for dispensing creams, emulsions, and the like which are dispensed or extruded through openings or apertures by pressurizing the cream, emulsion or the like.

As is known to those skilled in such dispenser arts, such cream, emulsion or the like is placed in a container above a pusher or plunger which is advanced, generally by rotating an associated member which is usually the applicator, whereupon the pusher or plunger is advanced within the container to pressurize the cream, emulsion or the like and dispense or extrude it through openings formed in the applicator. As is further known to those skilled in the art, such dispensers dispense a cream, emulsion or the like when the applicator is rotated in but one direction and such dispensers do not dispense upon the applicator being rotated in the opposite direction. Hence, a user of such dispenser upon rotating the applicator in the improper direction may falsely believe the dispenser to be empty and may discard a dispenser in anger believing the provider of the cream, emulsion or the like to have short changed him by selling him a dispenser only partially filled. This phenomenon can cause undeserved ill will toward the supplier of the cream, emulsion or the like and can cause the undue loss of sales.

Accordingly, there exists a need in the dispenser art for a dispenser wherein the applicator which is rotated to cause dispensing of the dispensable material can be turned in only one direction, i.e. the proper direction causing dispensing, and wherein the applicator cannot be rotated in the improper direction which does not cause dispensing or wherein the applicator may be rotated only limitedly in the improper direction. Such control of direction of rotation of the applicator causing dispensing will insure that the user of the dispenser exhausts the entire supply of cream, emulsion or the like available for dispensing and hence the supplier of the dispensable material will enjoy increased good will and increased sales.

Still further, as is known to those skilled in the dispenser art wherein the dispensable material such as a cream, emulsion or the like is dispensed by pressurizing such dispensable material, the problem of post-dispensing continues to persist and perplex. The problem of post-dispensing is the problem of unwanted dispensing of dispensable material after the user of the dispenser has ceased to operate or rotate the applicator to cause wanted dispensing. As is known to those skilled in such dispenser art, once the user has rotated the applicator sufficiently to cause the wanted amount of dispensing, and upon cessation of rotation of the applicator, further unwanted dispensing occurs—this further unwanted dispensing of dispensable material being known as post-dispensing. While not wishing to be bound by theory, post-dispensing is generally believed to be caused by the fact that the dispensable material, cream, emulsion or the like, is at least partially compressible or pressurizable and hence upon the dispensible material being compressed or pressurized to cause wanted dispensing and upon further pressurizing ceasing, the compressed or pressurized dispensable material attempts to expand thereby causing the unwanted post-dispensing. Alternatively, and again not wishing to be bound by theory, it is also generally believed that such dispensable material such as a cream, emulsion or the like, includes or has entrapped therein air bubbles which are partially compressible or pressurizable and these air bubbles upon being partially compressed or pressurized during wanted extrusion cause the post-dispensing upon cessation of the wanted dispensing by the user.

Accordingly, there exists a need in the dispenser art for a dispenser provided with means for preventing such post-dispensing of dispensable material.

SUMMARY OF THE INVENTION

The present invention provides a dispenser including means for controlling the direction of rotation of a rotatable member which causes dispensing and which limits or prevents rotation of such rotatable member in the improper direction which does not cause wanted dispensing of dispensable material.

Such means includes structure for allowing limitless rotation of the rotatable member causing wanted dispensing in the proper direction and which structure prevents or limits the amount of rotation of such rotatable member in the improper direction which does not cause wanted dispensing of the dispensable material.

Additionally, the present invention provides a dispenser with structure for preventing post-dispensing and which structure automatically causes a predetermined, limited amount of rotation of the applicator which causes wanted dispensing in the opposite direction which does not cause dispensing thereby relieving any compressing or pressurization of the dispensable material such as a cream, emulsion or the like.

DESCRIPTION OF THE DRAWINGS

FIG. 1 is a vertical cross-sectional view of such dispenser,

FIG. 2 is a partial side view of the rotatable applicator,

FIG. 3 is a top view of the container taken along the line 3—3 in FIG. 1 but with the dispenser closure being removed for clarity, and FIG. 4 is a partial side view taken from the container shown in FIG. 3.

FIG. 5 is a partial vertical cross-sectional view of a dispenser applicator and container, and FIG. 6 is a partial diagrammatic illustration taken along the line 6—6 in FIG. 5 and in the direction of the arrows and showing a portion of a rotatable applicator.

DESCRIPTION OF THE INVENTION

Referring now to FIGS. 1–4, there is shown, diagrammatically, a dispenser indicated by general numerical designation 10 embodying the first embodiment of the present invention, namely, embodying means for controlling the direction of relative rotation of a rotatable member with respect to a container to thereby control the dispensing of the dispensable material received within the container.

Figure 1:
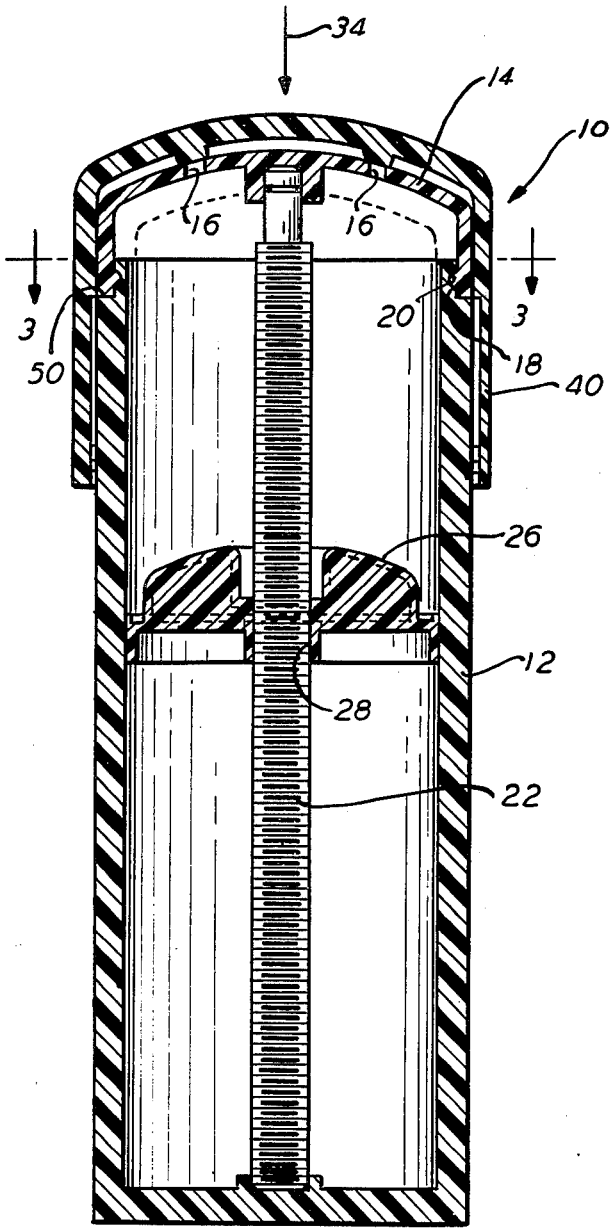
FIGS. 1–4 are diagrammatic illustrations of a first embodiment of a dispenser according to the present invention.

More particularly, and referring to FIG. 1, the dispenser 10 may include a generally cylindrically shaped container 12 closed at the bottom and open at the top.

Further, the dispenser 10 may include a generally dome shaped rotatable member or applicator 14 having a plurality of openings or apertures 16 formed in the top thereof. The rotatable applicator 14 is provided with an annular and radially inwardly extending rib 18 which is received slidably in an annular groove 20 formed in the upper portion of the container 12. The fit between the rib 18 and groove 20 is sufficiently tight to retain the rotatable applicator 14 and container 12 in engagement during normal operation of the dispenser 10 and the fit between the rib 18 and groove 20 is sufficiently loose to permit relative rotation of the rotatable applicator 14 with respect to the container 12.

Further, the dispenser 10, as shown in FIG. 1, further includes an externally threaded screw 22 the top of which is fixedly secured to the underside of the rotatable applicator 14 to cause the threaded screw 22 to rotate with the rotatable applicator 14 and the bottom of the threaded screw 22 is provided with a pointed end received rotatably in a complementarily shaped and conical well formed in the bottom of the container 12. The upper portion of the screw 22 may be fixedly secured to the underside of the rotatable applicator 14 by being either formed integrally therewith or by being formed separately and by being fixedly secured to the rotatable applicator 14 such as by a suitable adhesive.

Still further, the dispenser 10 may include a generally dome shaped pusher or plunger 26 provided with a centrally formed passageway 28 which is provided with internally formed threads complementary to the externally formed threads provided on the screw 22. The threaded passageway 28 of the pusher 26 is for threadedly receiving the screw 22 as shown. The pusher or plunger 26 is provided with a pair of diametrically opposed and vertically extending grooves formed in the outer periphery thereof (not shown) which grooves are for receiving the inwardly and vertically extending ribs 32 (FIG. 3) formed on the interior of the container 12. Such grooves and ribs 32 prevent the pusher 26 from being rotated and limit the pusher 26 to translational movement vertically upward and vertically downward.

In the embodiment shown in FIG. 1, the screw 22 is provided with external threads spiralling downwardly from the top to the bottom and thus, upon the rotatable applicator 14 and screw 22 being rotated counterclockwise with respect to the container 12 as viewed downwardly in the direction of the arrow 34, the pusher 26 is caused to move vertically upwardly by the screw 22 thereby dispensing any dispensable material contained within the container 12 above the pusher outwardly through the openings 16 formed in the applicator 14. Contrarily, upon the rotatable applicator 14 being rotated clockwise with respect to the container 12 as viewed in the direction of the arrow 34, the pusher 26 is caused to move vertically downwardly in the container 12 by the screw 22 whereby any dispensable material contained in the container 12 above the pusher 26 is not dispensed outwardly through the openings 16 formed in the applicator 14.

It will be further understood by those skilled in the dispenser art that by reversing the direction of spiral of the threads formed on the exterior of the screw 22 the pusher 12 would be caused to move in the opposite vertical directions upon the rotatable applicator 14 being rotated in the counterclockwise and clockwise directions with respect to the container 12. Additionally, as is known to those skilled in the dispenser art, the dispenser 10 may be further provided with a cap or closure 40 for engaging the upper portion of the cylinder 12 in an air-tight engagement so as to prevent the unwanted access of air to the passageways 16 and hence to the dispensable material contained in the container 12 during periods of non-use of the dispenser 10.

As noted above, the embodiments of the present invention provide a dispenser including means for controlling the direction of relative rotation of the rotatable applicator 14 with respect to the container to thereby control the dispensing of the dispensable material and to prevent the user of the dispenser from inadvertently rotating the applicator in the improper direction and thereby incorrectly believing that the dispenser is empty when in fact the dispenser includes dispensable material which will be dispensed upon the applicator 14 being rotated in the proper direction with respect to the container 12. More specifically and referring to FIGS. 2–4, such means for controlling the direction of relative rotation of the rotatable applicator 14 with respect to the container 12 may, in accordance with the teachings of the present invention, comprise a pawl 44 projecting or extending downwardly at a point around the lower edge or periphery 46 of the rotatable applicator 14. In addition, such controlling means may include a plurality of annularly arranged slots 48 formed in the upper edge 50 of the upper portion of the container 12. As may be best seen in FIG. 4, each of the slots 48 is defined by a first wall 52 inclined in the direction of rotation of the rotatable applicator 14 with respect to the container 12 which causes material to be dispensed and by a second wall 54 opposite the first wall and extending vertically.

In operation, and with the rotatable applicator 14 being assembled to the container 12 as described above, the pawl 44 provided on the applicator 14 extends downwardly and is received within one of the annularly arranged slots 48 formed in the container 12. Thus, upon relative rotation of the rotatable applicator 14 in the counterclockwise direction with respect to the container 12, and as viewed in the direction of the arrow 34, the pawl 44 and hence the rotatable applicator 14 will be cammed upwardly by the inclined walls 52 thereby permitting limitless rotational movement of the applicator 14 in the counterclockwise direction with respect to the container 12—the pawl 44 moving or rotating limitlessly from slot 48 to slot 48 in the counterclockwise direction as viewed in the direction of the arrow 34 in FIG. 1 and as viewed in FIG. 3. Thus, it will be understood that upon the rotation of the applicator 14 in the counterclockwise direction with respect to the container 12, the inclined walls 52 allow limitless counterclockwise relative rotation of the applicator 14 with respect to the container 12 by allowing the pawl 44 to be cammed upwardly thereby permitting limitless rotational movement of the applicator 14 in the counterclockwise direction with respect to the container 12. It will be understood by those skilled in the art that the fit between the rib 18 formed on the interior of the rotatable applicator 14 and the annular groove 20 formed on the exterior of the container 12 is sufficiently loose to permit the slight vertically upward movement imparted to the rotatable applicator 14 upon it being rotated in the counterclockwise direction with respect to the container 12 and upon the pawl 44 being cammed upwardly by the inclined walls 52 of the slots 48.

However, upon any attempt by the user of the dispenser 10 to rotate the rotatable applicator 14 in the clockwise direction with respect to the container 12 as viewed in the direction of the arrow 34 of FIG. 1, the pawl 44 will enter one of the slots 48, if not residing therein upon cessation of rotation of the applicator 14 in the opposite direction, and the pawl 44 will engage the vertically extending wall 54 of the slot in which it resides whereby such vertically extending wall 54 will limit or prevent the pawl 44 and hence the rotatable applicator 14 from rotating in the clockwise direction with respect to the container 12. Hence, the user of the dispenser 10 upon being unable to rotate the applicator 14 in the clockwise direction with respect to the container 12 will recognize such failure or prevention of rotation of the applicator and will understand that an attempt is being made to rotate in the incorrect or improper direction of relative rotation with respect to the container 12 and hence the user will reverse the direction of rotation of the applicator 14 with respect to the container 12 thereby causing any dispensable material remaining in the container 12 to be dispensed.

It will be further understood by those skilled in the art that upon the external thread of the screw 22 of FIG. 1 being spiralled oppositely than as described above, that is upon the threads of the screw 22 being spiralled upwardly, the inclined walls 52 and vertically extending walls 54 defining the slots 48 would be reversed so as to control the relative rotation of the rotatable pusher 14 with respect to the container 12 so as to assure that the operator will rotate the applicator 14 only in the proper direction to cause dispensing of dispensable material.

It will be further understood by those skilled in the dispenser art that the expression "relative rotation of the rotatable applicator 14 with respect to the container 12" is an expression that merely connotes relative rotation. That is, and by way of example, the relative rotation of the rotatable applicator 14 with respect to the container 12 in the counterclockwise direction as viewed in the direction of the arrow 34 of FIG. 1, may be provided by either maintaining the container 12 stationary and by rotating the applicator 14 in the counterclockwise direction, or by maintaining the applicator 14 stationary and by rotating the container 12 in the clockwise direction, or by rotating the applicator 14 in the counterclockwise direction while the container 12 is being rotated in the clockwise direction.

Figure 2:
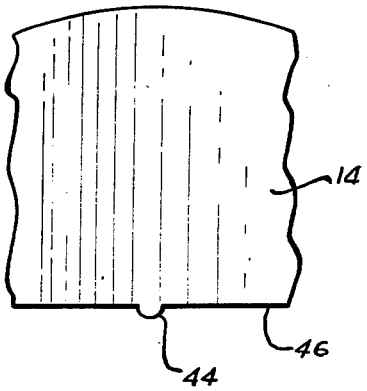
Figure 3:
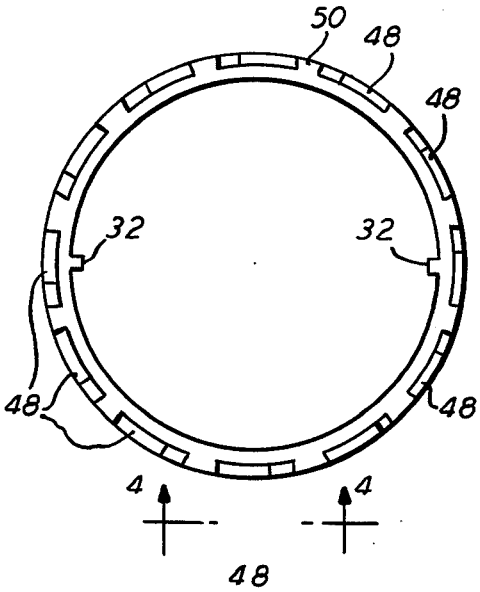
Figure 4:
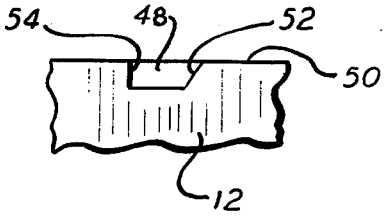

It will be still further understood by those skilled in the art, that contrary to the relative positionment of the pawl 44 and the annularly arranged slots 48 as shown in FIGS. 2 and 4, and in accordance with the further teachings of the present invention, the pawl 44 could be provided on the annular edge 50 of the container 12, extending upwardly therefrom, and the annularly arranged slots 48 could be provided on the lower annular edge 46 of the rotatable applicator 14, extending upwardly along the lower outer periphery of the applicator 14.

Thus, in brief summary, it will be further understood by those skilled in the dispenser art that the pawl 44 and the annularly arranged slots 48 are means for controlling the direction of relative rotation of the rotatable applicator 14 with respect to the container 12 to thereby control the dispensing of dispensable material contained within the container 12. More specifically, the pawl 44 and the annularly arranged slots 48 are means for allowing limitless relative rotation of the rotatable applicator 14 with respect to the container 12 in the counterclockwise direction of relative rotation as taught with regard to the embodiment shown on FIGS. 1–4, and that the pawl 44 and the annularly arranged slots 48 are means for limiting or preventing the relative rotation of the rotatable applicator 14 with respect to the container 12 in the clockwise direction of relative rotation as taught with regard to the embodiment shown in FIGS. 1–4.

Figure 6:
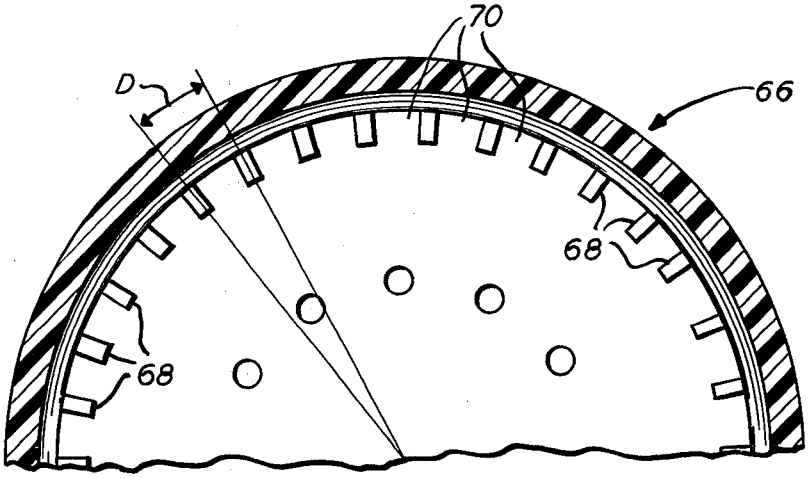
FIGS. 5–6 illustrate diagrammatically an alternate embodiment of a dispenser provided with structure according to the present invention.
Figure 5:
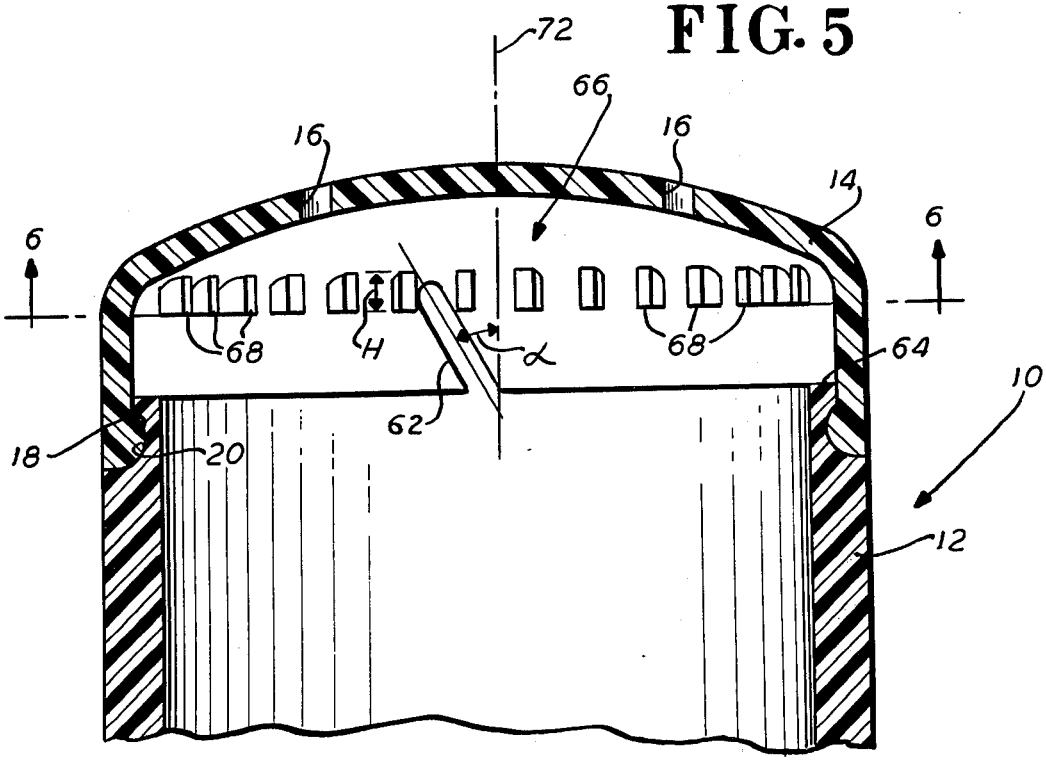

Referring now to FIGS. 5 and 6, there is further shown diagrammatically the second embodiment of the present invention wherein a dispenser is provided with means for controlling the direction of relative rotation of the rotatable applicator 14 with respect to a container 12. It will be understood by those skilled in the art that the embodiment of the present invention shown diagrammatically in FIGS. 5 and 6 includes substantially the same structure as shown in FIG. 1 for causing dispensing of dispensable material contained within the container 12 but that for reasons for clarity the screw 22 and pusher 26 have been omitted but that such structure is included in the embodiment of FIGS. 5 and 6.

More particularly, it will be understood that in the embodiment of FIGS. 5 and 6 the means for controlling the direction of relative rotation of the rotatable applicator 14 with respect to the container 12 may include a resilient pawl 62 provided on the upper edge 64 of the container 12 and a ratchet provided on the underside of the applicator 14 and being indicated by general numerical designation 66. The ratchet 66 is defined by a plurality of annularly arranged ribs or teeth 68 having slots 70 therebetween as shown particularly in FIG. 6.

As shown in FIG. 5, the container 12 has a vertical axis 72 and it will be understood that the resilient pawl 62 is inclined at a predetermined angle $\alpha$ with respect to the vertical axis 72 of the container 12. As is shown in FIGS. 5 and 6, the ribs or teeth 68 defining the ratchet 66 are of a predetermined height H and are spaced apart a predetermined arcuate distance D. In the preferred embodiment of the present invention shown in FIGS. 5 and 6, the resilient pawl 62 was inclined at an angle $\alpha$ of substantially 30° with respect to the vertical axis 72, the teeth 68 had a height H of 0.06 inch and were spaced apart a predetermined arcuate distance D of substantially 12°.

Upon assembly of the rotatable applicator 14 to the container 12 as illustrated in FIG. 5, the inclined resilient pawl 62 extends upwardly residing within a slot 70 formed between two adjacent teeth 68 of the ratchet 66. Thus, upon relative rotation of the applicator 14 in the counterclockwise direction with regard to the container 12 and with respect to the arrow 34 of FIG. 1, the teeth 68 bend the pawl 62 limitedly in its direction of inclination sufficiently to permit free relative rotation between the teeth and the pawl whereby limitless relative rotation of the rotatable applicator 14 with respect to the container 12 is allowed. Contrarily, upon relative rotation of the applicator 14 in the clockwise direction with regard to the container 12 and with respect to the arrow 34 of FIG. 1, the teeth 68 engage the pawl 62 and attempt to bend the pawl in the direction opposite to its direction of inclination whereby the pawl 62 is wedged between the two adjacent teeth in which the pawl resides at the initial relative rotation of the applicator 14 in the clockwise direction with regard to the container 12 and relative rotation of the applicator 14 in the clockwise direction with regard to the container 12 is limited by such wedging action and being determined by the height H of the teeth 68 and the predetermined arcuate spacing D between the teeth. In an embodiment of the present invention wherein the arcuate spacing D between the teeth 68 shown in FIG. 6 was substantially 12°, the limited relative rotation of the applicator 14 in the clockwise direction with regard to the container 12 was limited to substantially 12° of relative rotation.

It will be further understood by those skilled in the dispenser art that the second embodiment of the present invention illustrated diagrammatically in FIGS. 5 and 6 also includes means for automatically causing a predetermined amount of relative rotation of the rotatable applicator 14 with respect to the container 12 to prevent the above-noted prior art problem of post-dispensing of dispensable material. More specifically, it will be understood that the pawl 62 and ratchet 66 also provide such automatically operable means.

Still more specifically, upon the above-noted relative rotation of the rotatable applicator 14 in the counterclockwise direction with respect to the container 12 and upon the cessation of such relative rotation, the resilient pawl 62 will be bent limitedly forwardly in its direction of inclination and will reside between two adjacent teeth 68 and upon free relative rotation between the applicator 14 and container 12 being permitted (that is upon the user ceasing rotation of the applicator 14 to cause intended cessation of dispensing) the limitedly bent resilient pawl 62 will return to its predetermined angle of inclination with respect to the vertical axis 72 of the container and in so doing will thereby impart limited relative rotation to the teeth 68 and hence to the rotatable applicator 14 to cause the applicator 14 to rotate clockwise with respect to the container 12 whereby the screw 22 (FIG. 1) will be rotated in the clockwise direction thereby causing said pusher 26 (FIG. 1) to move vertically downwardly thereby relieving any pressurization of the dispensable material residing in the container 12 above the pusher and thereby preventing post-dispensing of the dispensing material.

In the embodiment of the present invention shown diagrammatically in FIGS. 5 and 6 wherein the predetermined arcuate spacing D between the teeth 68 of the ratchet 66 was substantially 12°, the automatically caused predetermined amount of relative rotation between the rotatable applicator 14 and the container 12 in the clockwise direction was also substantially 12° of relative rotation.

It will be understood by those skilled in the dispenser art that the embodiment of the present invention illustrated diagrammatically in FIGS. 5 and 6 may be provided with a screw 22 (FIG. 1) which may be spiralled in either direction whereupon the applicator 14 will be rotatable in accordance with the teachings of the present invention in either the relative clockwise or counterclockwise direction accordingly. Similarly, it will be understood that the above-noted definition of the expression, "relative rotation of the applicator 14 with respect to the container 12", is equally applicable to the embodiment of FIGS. 5 and 6.

It will be further understood by those skilled in the dispenser art that the dispenser of the present invention may be made of a suitable polypropylene material. Such material provides the structural characteristics required in causing a dispenser to operate and function in accordance with the teachings of the present invention.

It will be further understood by those skilled in the art that many variations and modifications may be made in the present invention without departing from the spirit and the scope thereof.

What is claimed is:

1. In a dispenser including a container and a rotatable member and wherein relative rotation of said rotatable member with respect to said container in a predetermined direction of relative rotation causes dispensing of dispensable material contained in the container, and wherein relative rotation of said rotatable member with respect to said container in the opposite direction to said predetermined direction of relative rotation does not cause dispensing of said dispensable material, said container having a vertical axis the improvement comprising:

a resilient pawl provided on one of said rotatable member or said container, a ratchet provided on the other of said rotatable member or said container, said ratchet defined by a plurality of annularly arranged teeth having slots therebetween and said teeth being of a predetermined height and spaced apart a predetermined arcuate distance, said pawl being inclined at a predetermined angle with respect to said vertical axis of said container and being bendable limitedly in said direction of inclination and said pawl engaging said ratchet with the upper end of said pawl extending into said ratchet slots, upon said relative rotation of said rotatable member with respect to said container in said predetermined direction of relative rotation said teeth and said pawl rotate freely with respect to each other with said teeth bending said pawl limitedly in said direction of inclination thereby allowing limitless relative rotation of said rotatable member with respect to said container in said predetermined direction of relative rotation, and upon said relative rotation of said rotatable member with respect to said container in said opposite direction of relative rotation said teeth engage said pawl and said pawl is wedged between the two adjacent teeth in which said pawl resides at the initial relative rotation of said rotatable member with respect to said container in said opposite direction thereby limiting relative rotation in said opposite direction determined by said predetermined height of said teeth and said predetermined arcuate spacing between said teeth.

2. In a dispenser including a container and a rotatable member and wherein relative rotation of said rotatable member with respect to the container in a predetermined direction of relative rotation causes dispensing of dispensable material contained in the container, and wherein upon said relative rotation of said rotatable member with respect to said container in said predetermined direction of rotation and upon the cessation thereof post-dispensing of said dispensable material occurs, and wherein relative rotation of said rotatable member with respect to said container in the opposite direction to said predetermined direction of relative rotation does not cause dispensing of said dispensable material, said container having a vertical axis the improvement comprising:

a resilient pawl provided on one of said rotatable member or said container, a ratchet provided on the other of said rotatable member or said container, said ratchet defined by a plurality of annularly arranged teeth having slots therebetween, and said teeth being of a predetermined height and spaced apart a predetermined arcuate distance, said resilient pawl being inclined at a predetermined angle with respect to said vertical axis of said container and being bendable limitedly in said direction of inclination and said pawl engaging said ratchet with the upper end of said pawl extending into said ratchet slots, upon said relative rotation of said rotatable member with respect to said container in said predetermined direction of relative rotation said teeth and said pawl rotate freely with respect to each other with said teeth bending said pawl limitedly in said direction of inclination, upon said cessation of relative rotation of said rotatable member with respect to said container in said predetermined direction of relative rotation said limitedly bent pawl residing between two adjacent teeth and upon free relative rotation between said rotatable member and said container being allowed said limitedly bent resilient pawl returning to said predetermined angle of inclination with respect to said vertical axis of said container thereby imparting a predetermined amount of limited relative rotation to said teeth and thereby to said rotatable member with respect to said container in said opposite direction of relative rotation thereby preventing said post-dispensing of said dispensable material.

3. A dispenser according to claim 2 wherein said predetermined angle which said pawl is inclined with respect to said vertical axis is approximately 30° and wherein said predetermined arcuate distance said teeth are spaced apart is defined by an angle of approximately 12° measured from the center of said annularly arranged teeth and wherein said predetermined amount of limited relative rotation of said rotatable member with respect to said container in said opposite direction of relative rotation is substantially 12° of relative rotation.

* * * * *